United States Patent [19]

Landry et al.

[11] 4,432,209

[45] Feb. 21, 1984

[54] SECONDARY COOLING SYSTEM FOR GAS COMPRESSORS

[76] Inventors: James E. Landry, 107 F Williamsburg Cir., Lafayette, La. 70508; Richard B. Babb, Rte. 2, Box 5, No. 124, Scott, La. 70583

[21] Appl. No.: 390,322

[22] Filed: Jun. 21, 1982

[51] Int. Cl.[3] ..... F25D 25/00

[52] U.S. Cl. ..... 62/62; 62/323.1; 62/505; 277/22; 415/180

[58] Field of Search ..... 62/505, 323.1; 277/22; 415/180; 62/62

[56] References Cited

U.S. PATENT DOCUMENTS 2,807,147 9/1957 Jacobs ..... 62/323.1

3,874,676 4/1975 Taylor et al. ..... 277/22

*Primary Examiner*—Ronald C. Capossela

*Attorney, Agent, or Firm*—Bode & Smith

[57] ABSTRACT

A secondary cooling system for cooling the packing case of a gas compressor which is engine driven, whereby the engine and gas compressor would continue to be cooled by the primary cooling system, and the packing case would be cooled by a secondary cooling system which would provide for a system for circulating coolant through the packing case of a gas compressor in order to provide transfer of heat from the packing case into the coolant for maintaining the final phase at the desired temperature and recirculating the coolant back into the secondary cooling system into a chiller means providing temperature of the coolant to the desired degree for cooling the packing case, which is reduceably less in the engine itself. There is further provided a means for monitoring the temperatures, pressures, flow, etc. within the closed secondary cooling system, and a master control board for monitoring the various devices and receiving and reading out the information to a controller.

16 Claims, 3 Drawing Figures

SECONDARY COOLING SYSTEM FOR GAS COMPRESSORS

BACKGROUND OF THE INVENTION

1. Field of the Invention

The present invention relates to cooling systems for gas compressors and the like. More particularly, the present invention relates to a secondary cooling system for a gas compressor and the like for particularly cooling the packing case in the cylinder of the compressor by providing a secondary coolant within the system.

2. General Background

At the present time large gas compressors are utilized in various phases of industries, particularly in refineries, wherein gas has to be transported under compression, in lift stations for lifting gas out of the earth, or for storing gas under pressure back into the earth. This is, in most cases, accomplished by the use of a compression system whereby the gas is pumped under pressure via the use of one or more cylinders forcing the gas into storage or transport.

One of the primary concerns in the use of a gas compressor for compressing gas within the system is to make certain that the gas compressor is maintained at a reasonable temperature so that the engine which is supplying the power to the gas compressor is maintained at one temperature, that is the temperature to keep the engine running at its peak, and yet the gas compressor itself be maintained at a lower temperature so that certain elements within the compressor are not damaged due to excessive heat.

At the present time, in most cases, this requires a three-phase cooling system which provides a coolant solution to circulate through a piping system within the engine and gas compressor for cooling the engine and gas compressor at the various phases. The first phase includes a radiator, which is very common in the art, wherein the water or coolant is transported through the radiator for release of the heat into the atmosphere. Upon leaving the radiator, the water is pumped via a water pump or the like into the engine where it is transported into a series of pipes for cooling the engine. In the next phase, the water, upon leaving the engine, moves into the cylinder cooling chamber of the compressor in order to cool the cylinder. Since the cylinder area is somewhat smaller than the engine itself, the piping around the cylinder is reduced in size, which in itself contributes to overheating. Upon leaving the cylinder, the water then enters the third phase of again smaller piping for cooling the packing case around the compressor rod itself.

The packing case is comprised of a series of metal cups which encase the compressor rod between the cylinder head and the drive shaft. Within the metal cups is packing material. During the compression of the gas by the piston to the cylinder head, some of the gas is able to escape behind the piston and move along the compressor rod. In order to effectively reduce the pressure of this gas and to nullify any pressurized gas moving in that direction, the packing case serves as an obstruction for the gas as it passes through the series of metal cups with the packing material, and at the point where the gas has made it through the last cup, it simply vents out into the atmosphere, as a harmless byproduct.

However, with the movement of the compressor rod within the packing case, tremendous heat is built up. Therefore it is essential that the packing case be maintained at a relatively cool temperature. That is accomplished by the use of water or coolant flowing around the packing case for transfer of the heat within the packing case into the water. If such is not accomplished at the right temperature, the compressor rod and rod packing becomes overheated and may be damaged, causing shutdown in the compressor and loss of valuable time and manpower.

The most significant problem confronted in the present state of the art is that the cooling system for engine drive compressors is designed to maintain the water or coolant at a temperature which is adequate to cool the engine but too high to adequately cool the compressor. Therefore, the water which is routed in this multiphase system through the radiator, the engine, the cylinder and the packing case, is retrieved from the packing case at an unacceptably high temperature. As this water is simply re-routed back into the radiator, the radiator, regardless of size, is not able to cool the water down to much below that of ambient temperature resulting in unacceptably high temperature of the water. Although this temperature of the water is suitable for the cooling of the engine, since engines would tend to run at that temperature of coolant extracting heat, the temperature of the packing case must be reduced to a temperature down between 85° F. and 100° F. (OEM Recommendation). Since in the multi-phase system, the water upon leaving the engine goes into the cylinder and finally into the packing case, the temperature of the water is necessarily higher than recommended, and therefore, the packing case becomes overheated, and damage insues to the compressor rod and packing material.

Therefore, it is necessary that a system be developed which would provide a secondary cooling system for maintaining the water coolant at a temperature suitable for the packing case, and utilize a primary cooling system for the engine itself.

Several patents have been found which speak to the cooling system for internal combustion engines, the most pertinent being as follows:

U.S. Pat. No. 1,651,157 issued to S. W. Rushmore entitled "Cooling System" would teach the use of a cooling system for internal combustion engines having a forcefeed water circulating system of small heat disapating capacity, including a water jacket, a high level overflow outlet from the jacket, with the method being by boiling and condensing coolant.

U.S. Pat. No. 2,789,647 issued to K. W. Couse entitled "Motor Vehicle Cooling System With Auxiliary Radiator" would teach the use of an internal combustion engine having an auxiliary radiator with pipes connecting the sections of the auxiliary radiator to the main radiator to provide further cooling of the water.

U.S. Pat. No. 3,780,712 issued to Pace entitled "Marine Engine Cooling" teaches the use of an improved water jacketed manifold for marine engine cooling system wherein heated water has circulated through an engine and is mixed with an improved engine manifold water cooled by a water jacket with raw, relatively cool water for cooling the manifold and avoiding condensing water from the exhaust gases flowing through the exhaust manifold.

U.S. Pat. No. 2,887,097 issued to Huffman, Sr., et al. entitled "Supplemental Cooling System For Engine Radiators" which teach the use of a multiple radiator for helping to cool engines rather than the use of a single radiator.

U.S. Pat. No. 1,974,907 issued to Worth entitled "Engine Cooling System" would teach the use of two internal combustion engines having cooling jackets arranged for independent or simultaneously operations so as to permit mixture of the cooling medium from the two systems whereby to insure delivery of cooling medium at the same temperature to each system.

U.S. Pat. No. 2,262,659 issued to M. Ware entitled "Internal Combustion Engine" would teach the use of an engine within a power plant with circulatory fluid heat transfer systems for a pair of engines of a connection between the systems for diverting a portion of the heated fluid in either system to the other system and means for controlling the flow of fluid through the connection.

U.S. Pat. No. 1,643,510 issued to Muir entitled "Variable Temperature Cooling System For Internal Combustion Engines" would teach the combination of a water jacket, means for cooling the fluid in the jacket, means for regulating temperature to which the fluid is cool while the engine is running in a vent for permitting the escape of air from the system with a control for controlling the vent.

And U.S. Pat. No. 3,134,371 issued to Crooks entitled "Cooling System For Internal Combustion Engines" would teach a method of cooling an internal combustion engine providing a large recirculating flow of cooling fluid through the jacket in the engine and having a second cooling circuit, and maintaining the second coolant circuit at as low a temperature as possible to provide better cooling of the system.

GENERAL DISCUSSION OF THE PRESENT INVENTION

The present invention solves the problems and shortcomings in the present state of the art in a simple and straightforward manner. The present invention would provide for a secondary cooling system for gas compressors and the like, to be utilized in unison with the primary cooling system. The radiator, which is the primary cooling system, would deliver coolant into a system of cooling chambers within the engine. Upon leaving the engine it is piped into the cylinder for the purpose of cooling the cylinder. Instead of the additional movement to the packing case, coolant is routed through an altered piping system to return the coolant to the primary cooling source. The secondary cooling system of the present invention would provide for a second system for circulating the water through the final cooling phase whether it be the cylinder or the "packing case" of a gas compressor in order to provide transfer of heat from the gas compressor into the collant for maintaining the final phase at the desired temperature and recirculating the water back into the secondary cooling system into a mechanical chiller providing temperature of the coolant to the desired temperature for cooling the packing case, which is reducibly less than the engine itself. There is further provided a means to monitor the temperatures, pressures, flow rate, etc. within the closed secondary cooling system. Preferably the entire system's functions could be monitored by a master control board which would receive and readout the information to a controller, or provide for automatic adjustments to the system.

Therefore, it is an object of the present invention to provide a secondary cooling system for a gas compressor for cooling the final phase of that mechanical system requiring coolant.

It is another object of the present invention to provide a system for reducing the temperature of the coolant in the packing case below the temperature of the coolant in the primary engine cooling system.

It is yet another object of the present invention to provide an independent secondary cooling system for the packing case in a gas compressor and the like utilizing means for reducing the temperature within the coolant quickly, effeciently, and monitoring the secondary cooling system during the process.

In order to accomplish the above objects of the present invention, it is a feature of the present invention to provide a mechanical chilling apparatus for receiving the coolant from the radiator within the secondary cooling system and reducing significantly the temperature of the coolant.

It is yet another feature of the present invention to provide a means for circulating the coolant by means of a pump within the secondary cooling system independent of the primary cooling system.

It is yet another feature of the present invention to provide a means of monitoring the coolant pressure, the coolant temperature, and the effectiveness of the system during the secondary cooling process.

BRIEF DESCRIPTION OF THE DRAWING

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figures 1, 2:
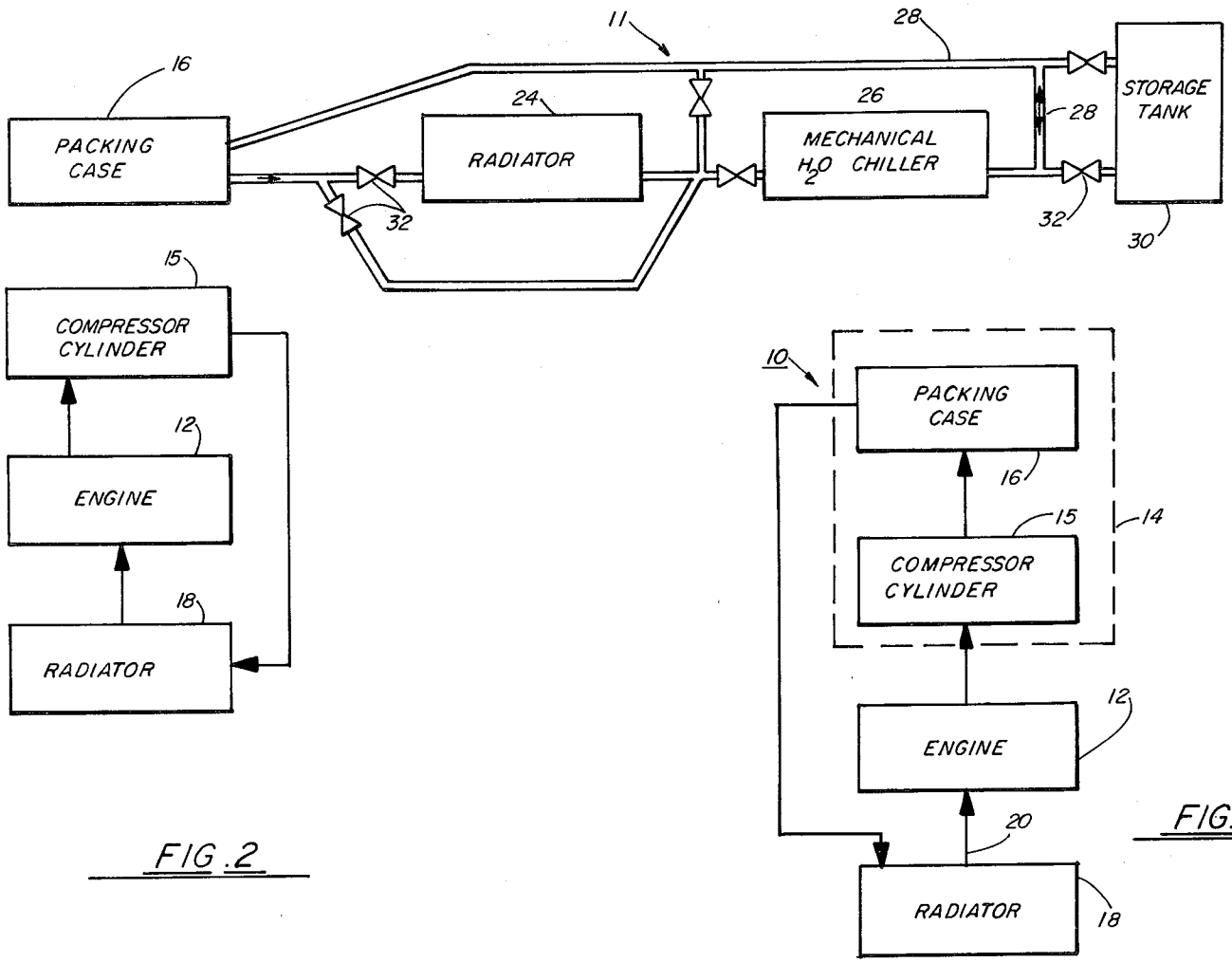
FIG. 1 is a schematic view of the present state of the art in the field of the present invention.
FIG. 2 is a schematic view of both the primary cooling system and the secondary cooling system in the preferred embodiment of the method of the present invention.
Figure 3:
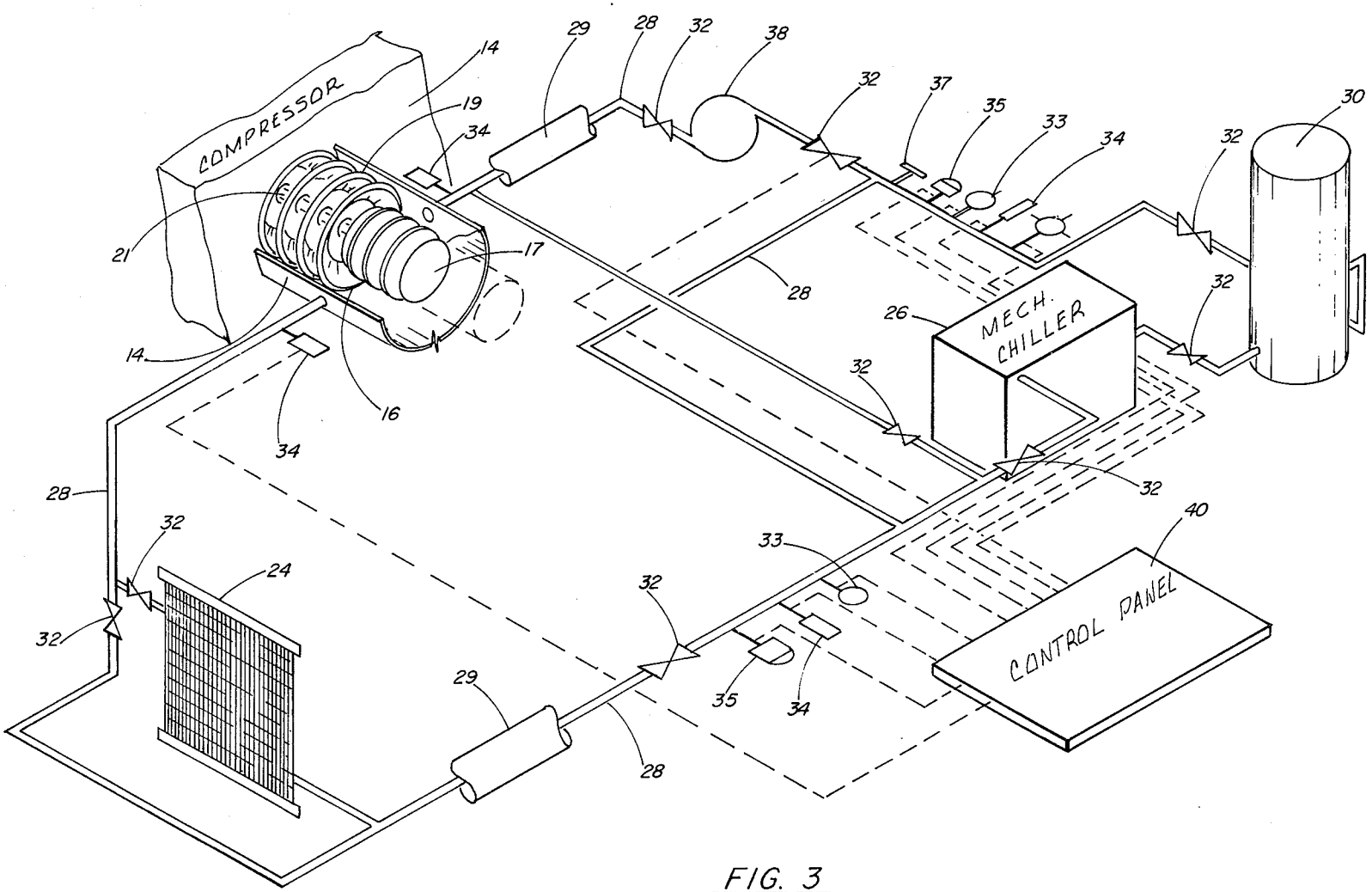
FIG. 3 is a perspective schematic view of the preferred embodiment of the secondary cooling system in the method of the present invention, illustrating the various means for monitoring the system during operation.

FIGS. 1–3 best illustrate the preferred embodiment of the system and apparatus of the present invention, with FIG. 3 illustrating primarily the system in the preferred embodiment.

FIG. 1 illustrates, in schematic drawing, the typical primary water cooling system 10 for cooling engine 12 and compressor 14 in an internal combustion driven gas compressor. As is illustrated in FIG. 1, in schematic engine 12 would be a typical combustion engine having a compressor unit 14 illustrated in phanthom which would normally comprise a cylinder 15 and a piston or pistons for compressing the gas for storage or transport within a transport system. As illustrated in FIG. 1, the typical compressor cylinder 15 would include a packing case 16, which is essentially a series of metal cups housing the packing around the compressor rod (See FIG. 3). The primary function would be to prevent or slow down the flow of any gas which may escape between the piston and the wall of the cylinder. Any anticipated escape of the gas would be slowed to such an extent, that the gas which did escape the packing case, would vent harmlessly into the atmosphere.

The primary function of FIG. 1 is to illustrate the system in which a typical water cooled engine and gas compression system is cooled, in an effort to prevent the system from overheating. There is a further illustration in FIG. 1, radiator 18, which would be a typical radiator for exposing as much of the heated water in the system to the ambient atmosphere, for release of the heat into the atmosphere, and for cooling with the use of a fan and the like as in a typical radiator system. The system, of course, is a closed system so that the water, once cooled in the radiator, is circulated as illustrated in the direction of line 20 back through engine 12, where it travels through a series of chambers for transferring the heat generated by engine 12 into the water in helping to cool the engine.

However, following the movement of the water through engine 12, under the typical cooling system at the present time, the water would then be channeled through a second series of piping within cylinder 15 itself, for receiving further heat generated by the cylinder. Following that heat exchange, the water would then be further channeled in a third phase of the system; the packing case 16, via an even smaller series of pipes, to receive more heat from packing case 16, that heat having been generated by the movement of the compressor rod through the packing case as it functions in the compression of the gas. After the heat is removed from packing case 16, or is attempted to be removed, the water is channeled back into the radiator 18 where the heat is then disapated into the atmosphere. This process is repeated throughout the use of the engine and compressor.

One of the shortcomings of this system is that the water in the system will reach a maximum temperature above that which could effectively cool the final phase, and will be reduced at maximum efficiency a few degrees below ambient temperature. The engine requires a higher operating temperature as compared to the packing case. The packing case temperatures are higher as a result of engine required temperatures.

However, it has been found that the temperature of the water which is channeled within packing case 16 should be in the range of 85° F.–100° F. according to OEM specifications in order for internal moving parts not to be damaged. As one can readily see in the present system, radiator 18 is unable to release the necessary heat out of the water due to the higher heat requirement of the engine which would eventually result in damaging the rod packing and the compressor rod.

FIG. 2, in schematic view and FIG. 3, in component view, illustrate the preferred embodiment of the present invention, i.e. the secondary cooling system 11. FIG. 2 further illustrates the primary cooling system 10 having radiator 18, (as is illustrated in FIG. 1), with the necessary changes that have been made to system 10 in order to accommodate the secondary cooling system 11. Most importantly, radiator 18 would be continued to be utilized for cooling engine 12, with the water or coolant being rerouted between engine 12 and radiator 18, and compressor cylinder 15 bypassing packing case 16 housed there within.

It is the subject of the preferred embodiment of the present invention to provide secondary cooling system 11 which is also a closed cooling system containing water or coolant therein, for secondarily cooling through a separate system, packing case 16 housed within the final phase compressor 15.

As is illustrated in FIG. 2, in schematic, there is provided a closed system 11 having a second radiator 24 for receiving the heat ladened water from packing case 16, after the water or coolant has circulated through packing case 16. As with a typical fan-cooled radiator, the water would be cooled down to a certain temperature, but in this particular system 11, the water or coolant would be further routed into mechanical chiller 26, which is known in the art of cooling, but is a novel application in the cooling of water in a cooling system for gas compressors. The mechanical water chiller 26 would have the primary function of lowering the temperature of the water down to manufacturer's specifications in the preferred embodiment, wherein the water would then be routed through line 28 into packing case 16. Since the water has been cooled down to 70° F., its ability to maintain packing case 16 at the necessary temperature of 70° F.–100° F. for preventing damage to the internal workings of the compressor is accomplished, and the secondary cooling system enables the entire system to function at the correct temperature. However, the system may be able to provide cooling capacity far below 70° F., down to at least 66° below 0° F.

It is forseeable that the components of the system would not necessarily be in close proximity with one another, therefore the insulation 29 (FIG. 3) around line 28 is important in view of the fact that line 28 may extend a somewhat lengthy distance between components of the system, and unless insulated may result in the loss of that temperature necessary to cool packing case 16.

As is further illustrated in FIG. 2, there is provided a storage tank 30 which would be an alternative component in the system, whereby the water which has been cooled to the 70° F. by mechanical chiller 26, if not utilized, immediately could be maintained in chilled storage tank 30 at the "70° F. temperature for use when the water is needed. However, in the preferred embodiment, storage tank 30 would not be utilized, since it is foreseen that the mechanical water chiller 26 without use of storage tank 30 would be adequate to maintain the constant water requirements at the necessary temperature. The storage tank would be utilized for additional and occasional requirements of other equipment.

Also, it is foreseeable that if indeed a system is being used in a rather cold climate, the combination of the radiator 24 and the mechanical chiller 26 may not be necessary, so that the water could possibly be routed from packing case 16 into radiator 24 via line 28 bypassing mechanical chiller 26 and back into packing case 16 thus accomplishing the cooling cycle with the use of radiator 24 only. These functions would be monitored and executed by the control panel. Temperature sensors 34 are located at the inlet and outlet valves of the packing case 16 to monitor the temperature differential of the coolant. The control panel monitors the ability of each component to attain desired temperature in relation to ambient temperature.

FIG. 3 further illustrates in greater detail additional components of secondary cooling system 11 for monitoring the system and the actual components contained within packing case 16 which must be cooled in order for the system to function properly. As is illustrated in FIG. 3 there is again typical compressor 14 driven by a standard engine which illustrates in cutaway view compressor piston 17 having a series of metal cups 19 wherein the piston rod 21 would move back and forth during the compression of gas. Packing case 16 includes cups 19 housing a packing material whose function, as stated earlier, is to prevent the loss of gas rearward along the compressor rod 21, with most of the gas being stopped or slowed by the packing material and vented into the atmosphere. However, in order to cool packing case 16 in the preferred embodiment of the present system 11, there is again illustrated line 28 which would be an insulated line containing water or other coolant such as ethylene glycol which would be routed into radiator 24 for initial cooling, radiator 24 being a typical radiator for use in an internal combustion engine. Following the exiting from radiator 24, coolant would be routed again into insulated line 28, into mechanical chiller 26 wherein the water would be reduced to the desired temperature, with the water being routed back through insulated line 28 into packing case 16 for recirculation.

In this secondary system, the temperature of the water is maintained at a relatively low temperature during the compression of the gas, i.e. more desirable temperature below that of the ability of the present state of the art.

In the preferred embodiment of the system, since it is a closed system, the temperature and the pressure within the system must be maintained at a particular level in order for the entire system to function properly. In order to accomplish this, as is illustrated in FIG. 3, there is illustrated a series of monitoring devices which are positioned within the system for assuring that the system is maintained and controlled at its total functioning ability.

As is illustrated, after the coolant has exited radiator 24 and is flowing in line 28 to mechanical chiller 26, there is a valve 32 which is a typical valve within a line which could automatically or manually shut off the flow of water between radiator 24 and mechanical chiller 26 in the event of a breakdown in the system or ambient temperature is cool enough to allow radiator alone to operate effectively in cooling water to OEM specifications. Also, there are additional valves 32 within the system to interrupt flow to the chiller 26 or radiator 24 as the case may be, depending on the cooling needed. There is further provided in line 28 between radiator 24 and chiller 26 pressure guage 33 for maintaining the proper pressure within the line, thermometer 34 for monitoring the temperature of the water as it has left the radiator 24 and before entering chiller 26, and air vent 35 for release of any air within the line should air have built up in the system. Upon exiting water chiller 26, the coolant would flow into line 28 to packing case 16 and would be further monitored by a second thermometer 34, pressure gauge 33 and a second air vent 35. However, in this section of line 28 there is further provided a flow control valve 37 which would be utilized for maintaining the proper flow within the line, a second shutoff valve 32 and a typical pump 38 for maintaining the flow of the coolant within the closed system.

In order to properly maintain the function of the apparatuses along the flow line 28, there would be provided typical control panel 40 which would be a visual viewing panel, having monitor stations in the panel which have received impulses from the monitoring devices along line 28 and would read out on control panel 40. The individual components of the secondary cooling system are activated by the feedback that the monitoring devices give the control panel. Since, in fact, the makeup of the control panel would be a typical type of panel for monitoring the various readouts along the flow line 28 of the system, so that a single operator may monitor the entire system and take action should a certain aspect of the system fail to function correctly. In situations where the compressor station itself has a control panel—the secondary cooling system will be in conjunction in that the failure of either system will shut the other off.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method for independently cooling various components of a gas compressor, comprising the steps of:

a. providing a primary cooling system;
b. interrupting the flow of coolant within the primary cooling system into the components to be cooled;
c. providing a secondary source of coolant;
d. providing an inlet flow line into the components to be cooled and an outlet flow line out from the components to be cooled;
e. flowing said coolant through said components to be cooled within said inlet and outlet lines;
f. providing a first cooling means;
g. routing said coolant from said components to be cooled into a first cooling means;
h. providing at least a second cooling means;
i. routing said coolant from said first cooling means into at least said second cooling means; and
j. routing said coolant from said second cooling means into said inlet line of said components to be cooled.

2. The method in claim 1, further comprising the step of monitoring the temperature and pressure within said line between said components to be cooled, said first cooling means and said second cooling means.

3. The method in claim 1, further comprising the step of providing a pump means within said method.

4. The method in claim 1, further providing the step of insulating said lines between said components to be cooled, said first cooling means and said second cooling means.

5. The method in claim 1, wherein said first cooling means is a radiator.

6. The method in claim 1, wherein said second cooling means is a mechanical water chiller.

7. The method in claim 1, wherein the coolant is water or water containing ethylene glycol or the like.

8. The method in claim 1, further provides chilled coolant storage means.

9. The method of claim 1, wherein the components to be cooled is a packing case.

10. A method for cooling the internal components, in particular the packing case of a gas compressor system, which comprises the following steps:

a. providing an inlet line and an outlet line into and out of the packing case to be cooled;
b. flowing coolant such as water or water containing ethylene glycol or the like into and out of said packing case to be cooled;
c. flowing said coolant into a radiator means for initially releasing heat contained within said coolant;

d. flowing said coolant out of said radiator means into a mechanical chiller means for reducing the temperature of the coolant to a desired temperature;

e. flowing said coolant out of said chiller means back into said packing case for repeating of steps (b) through (e) above.

11. The method in claim 10, further providing the step of initially interrupting the flow of coolant from the primary engine cooling system.

12. The method in claim 10, further comprising the step of providing a pump for maintaining a constant flow within said system.

13. The method in claim 10, further providing means for monitoring the temperature, pressure and flow within the system.

14. The method in claim 10, wherein the flow lines between said radiator means said chiller means and said packing case are insulated for providing minimal heat gain while water is in route.

15. The method in claim 10, wherein there is further provided a single control means for monitoring the various monitoring stations, said control means further comprising an electrical control panel for visual viewing changes in said system.

16. In a gas compressor having an internal compressing means, a packing case surrounding the compressor rod, and a system for fluid cooling the compressor, compressor rod and the packing case in a series, interrupting the cooling system, and providing a method for independently cooling packing case, which comprises the following steps:

a. interrupting the flow of coolant within the cooling system into the packing case to be cooled;

b. providing a secondary source of coolant for the packing case;

c. providing an inlet flow line into the packing case and an outlet flow line out from the packing case to be cooled;

d. flowing said coolant through said packing case within said inlet and outlet lines;

e. routing said coolant from said packing case into a cooling means for cooling said coolant to a temperature not to exceed 100° F.;

f. routing said coolant from said cooling means back to said packing case;

g. monitoring the temperature pressure and flow rate within said method;

h. repeating steps d through g above.

* * * * *